United States Patent [19]

Bitsch

[11] Patent Number: 4,528,618

[45] Date of Patent: Jul. 9, 1985

[54] PICTURE-SCREEN WORK-STATION LAMP

[76] Inventor: Hans-Ulrich Bitsch, Schanzenstrasse 1, 4000 Düsseldorf 11, Fed. Rep. of Germany

[21] Appl. No.: 500,511

[22] Filed: Jun. 2, 1983

[30] Foreign Application Priority Data

Jun. 11, 1982 [DE] Fed. Rep. of Germany ..... 3222003

[51] Int. Cl.[3] ..... A61G 13/00

[52] U.S. Cl. ..... 362/33; 362/220; 362/238; 362/269; 362/287; 362/347; 362/419

[58] Field of Search ..... 362/33, 89, 129, 145, 362/147, 219, 220, 225, 233, 234, 235, 236, 237, 238, 239, 241, 248, 249, 250, 260, 269, 285, 287, 368, 370, 371, 372, 396, 413, 419, 420, 432, 388, 801, 804, 347

[56] References Cited

U.S. PATENT DOCUMENTS

| | | | |
|---|---|---|---|
| 20,431 | 6/1858 | Howard | 362/347 |
| 1,937,585 | 12/1933 | Luxmore | 362/269 |
| 2,041,474 | 5/1936 | Kirschmann | 362/413 |
| 2,555,000 | 5/1951 | Nitardy | 362/220 |
| 2,662,164 | 3/1951 | Murray | 362/1 |
| 2,712,056 | 6/1955 | Murray | 362/413 |
| 2,998,508 | 8/1961 | Bobrick | 362/801 |
| 3,110,446 | 11/1963 | Rathbun | 362/432 |
| 3,239,184 | 3/1966 | Kirkeby | 362/419 |
| 3,331,958 | 7/1967 | Adler | 362/260 |
| 3,676,667 | 7/1972 | Malifaud | 362/347 |
| 3,994,464 | 11/1976 | Perbal et al. | 362/419 |
| 4,090,210 | 5/1978 | Wehling et al. | 362/419 |
| 4,159,871 | 7/1979 | Arnone | 362/33 |
| 4,204,274 | 5/1980 | Lüderitz | 362/239 |
| 4,298,921 | 11/1981 | Krogsrud et al. | 362/269 |
| 4,386,392 | 5/1983 | Reibling | 362/349 |
| 4,388,678 | 6/1983 | Turner | 362/310 |
| 4,414,609 | 11/1983 | Shemitz | 362/248 |

FOREIGN PATENT DOCUMENTS

| | | | |
|---|---|---|---|
| 826611 | 1/1952 | Fed. Rep. of Germany | 362/432 |
| 868942 | 3/1953 | Fed. Rep. of Germany | 362/413 |
| 2654218 | 6/1978 | Fed. Rep. of Germany | 362/285 |
| 362143 | 7/1962 | Switzerland | 362/419 |

*Primary Examiner*—Craig R. Feinberg

*Attorney, Agent, or Firm*—Martin A. Farber

[57] ABSTRACT

A lamp for a picture-screen work station having a holder for a lamp body which has a reflector and a source of light, characterized by the fact that the holder is of bar shape and is displaceable in three dimensions by joints on its ends and bears two lamp bodies which are individually displaceable in three dimensions independently of each other.

11 Claims, 3 Drawing Figures

PICTURE-SCREEN WORK-STATION LAMP

Figure 1:
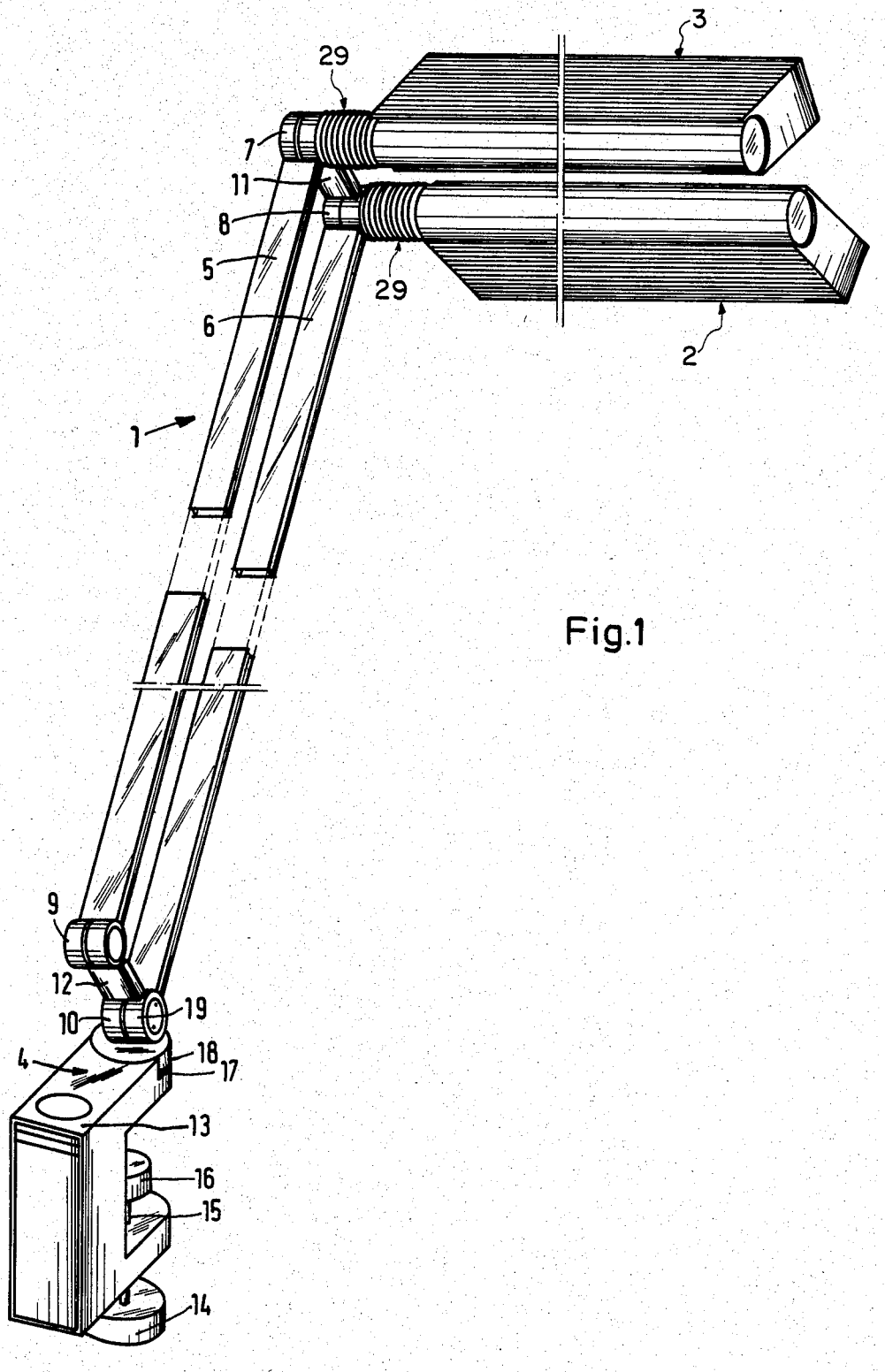

The invention concerns a picture-screen CRT work-station lamp with a holder for a lamp body containing a reflector and light source.

Work stations which make use of modern computer technology are being increasingly set up in government and industry. The operation of the equipment takes place with the use of a picture screen on which, for instance, bright characters, inter alia, appear as writing against a dark background or, in the reverse, as dark characters against a light background. The imaging of such picture-screen characters under conditions of daylight and artificial light represents a problem area which must be analyzed according to the criteria of industrial medicine. It is intended to take the requirements resulting from this into consideration in the development of a lamp for a picture-screen work station.

Picture-screen work stations have a work area which serves for the holding of and possibly working on copy such as electronic data-processing printouts and statements of account. The documents have completely different degrees of reflection (colors), are frequently positioned differently, and have certain angular positions on copy holders and similar devices and for these reasons cannot be sufficiently illuminated under all conditions of use with the previously known lamps. In addition there is the basic ergonomic requirement that optical differences should not be greater or less than about 3:1 within the work area nor about 10:1 in the further surroundings of the work area. These requirements are controlling for the creation of an illumination device.

Picture-screen work stations furthermore regularly have electronic devices which are operated by means of a keyboard and monitored by a picture screen. These devices are frequently kept smooth and polished and cause reflections which make operation and readability extraordinarily difficult. Even in so-called touch typing, visual verification of the input process is necessary and is carried out at least subconsciously, so that influences which impede this informational feedback which is necessary for the accuracy of the work process must be eliminated. From this there results a requirement to provide assurances, based on the illuminating device, that specular and other disturbing reflections cannot occur.

The design of the illumination at a picture-screen work station must also take into consideration the fact that devices are also placed both in areas close to windows where great brightness prevails and in areas which are distant from windows or windowless and where work can be carried out only under artificial light. Solutions must therefore be found which satisfy the following partially contradictory features:

The intensity of the illumination must be high enough that the reading of and working with copy is possible without difficulty. In this connection, within the overall field of vision of the user of a picture-screen work station, extreme contrasts with luminous-density ratios greater than approximately 1:15 must be absolutely avoided. Sufficiently high contrasts (1:3 to 1:10) are necessary, however, when the contrast performs a function in transmitting information. Thus the screen characters should stand out clearly against the screen background under all conditions of illumination which occur at a work station during work. On the other hand, when the contrast does not perform a function in the transmitting of information it should be kept as small as possible (at most 1:3). The design of the illumination must enable the user to control the luminous-density ratios at his work station. At the same time, the illumination must not produce contrast-reducing incident light or any sharp-edged reflections (specular reflections of bulbs, lamps or lamp parts) on the picture screen. Reflections, as is known, are one of the main causes of viewing difficulties during long work at a picture-screen work station. They have the result of bringing into action those complex internal regulating mechanisms which are responsible for adjusting the axis of both eyes to a graphic character. This mechanism of convergence regulation sees to it that the object being observed is sharply imaged in both eyes in the central region of the retina. Reflected images of bright objects with sharp edges are seen by the two eyes at different places of the picture screen. The convergence regulating mechanism is placed in a permanent conflict, the result of which are the asthenopic problems often complained of by users of picture-screen work stations such as nystagmus, blurriness of the images, burning of the eyes, pressure pain, increased tear secretion and/or headache.

These aspects cannot as a rule be satisfactorily taken into account solely by the known general illumination of the work space. The artificial light of the general illumination does not satisfy the requirements as to the illumination of work stations having picture screens, based on the present state of knowledge of the ergonomics and the science of working conditions. For this reason, a system of illumination has been developed which consists of ceiling lights and additional work station lights. The picture-screen work-station lamps known for this purpose have the form of a desk lamp with a single luminous body which illuminates the entire work station relatively uniformly and without differentiation. The size of the lamp is a disadvantage as is the fact that individual adaptation of the illumination to both the region of the copy holder and the region of the keyboard cannot be effected with it. The user can hardly bring the light to the place where it is needed. It also follows from this that direct dazzling of the user at the work station cannot be avoided in all positions of his or her body which is assumed in the course of the work to be carried out.

In view of this state of the art, the object of the invention is to develop a lamp for a picture-screen work station which has a comparatively small light-producing part which, while satisfying the fundamental requirements of industrial medicine and ergonomics of the type described above, permits individual illumination of both the place of the copy and the manual work area, particularly the keyboard, independently of the general room illumination and the position and arrangement of the elements of the work station.

This object is achieved in accordance with the invention in the manner that the holder is bar-shaped and is displaceable in all three dimensions by end articulations and that it bears two lamp bodies which are individually displaceable in all three dimensions independently of each other. One lamp body is intended to illuminate the operator's work copy and the other to illuminate the vicinity near the picture screen while avoiding direct impingement of the light on the picture screen proper of the work station. In this way an optimal solution is provided for the viewing tasks, since it is possible for the user to illuminate without reflection both the copy area and the picture-screen area of the work station independently of each other. The bar-shaped holder consists preferably of two bars movably connected with each other in a parallelogram arrangement, the connections of which are swivel joints, each bar bearing one lamp body. The two lamp bodies can be arranged on one or on both sides of the holder. Aluminum sections are proposed as bars. The parallelogram arrangement has the result that, in structurally simple manner and with the use of esthetic design features, maximum mobility of the picture-screen work-station lamp is obtained so that individual desires of the user of the work station for certain lamp positions and individual requirements as to the work station illumination associated therewith can be satisfied. The stability and strength of the construction is improved as compared to a single-bar holder. In order further to improve the mobility of the bars of the parallelogram arrangement an intermediate joint may be provided in each of them, preferably a swivel joint.

As swivel joints for each of the movable bar members there are preferably used roll joints whose guide curves slide on each other with adjustable frictional force. The roll joints can therefore be set in self-locking manner so that when the position of the lamp is changed the position set is automatically retained unchanged without the use of springs or such aids. Greater ease in operation as compared with known adjustable lamps is thereby obtained. For the setting of the position a screw may be provided in the joint in order more or less strongly to clamp the surfaces which slide on each other.

In combination with the embodiment of the picture-screen work-station lamp which uses roll joints it is advantageous to provide a swivel base in the region of attachment of the lamp. The swivel base may consist of a bracket in which a turnable disk is mounted, in particular on a plain bearing, to which disk one part of the articulation is fastened. The corresponding second part of the articulation then bears the holder of the lamp so that the combination of the roll joints with the swivel base assures in simple manner the desired three-dimensional displaceability.

From the viewpoints of design and better evaluation by the user of the illumination to be expected upon a change in position, it is proposed to develop the two lamp bodies identical to each other, each lamp body being produced advantageously in flat design with emergence of the light from the narrow side. A flat housing is developed on its inside as a channel reflector within which a lamp is held. In this way the danger of direct dazzling of the user is to a large extent prevented and an excellent directional effect of the illumination is obtained. The lamp bodies are extremely small. In the work premises, this minimal structural size of the lamp bodies hardly at all blocks one's view allowing visual contacts. This maximizes personal interaction and communication with other workers which are ordinarily very important psychologically and establishes an esthetically pleasing interior effect, permitting a more harmonious development of the work station as compared with large-size lamps.

The picture-screen work-station lamp described above can be provided, in traditional manner, with a clamp base, standing base or pin base, but it may also be fastened to the ceiling of a room, for instance by means of a track system.

Figure 2:
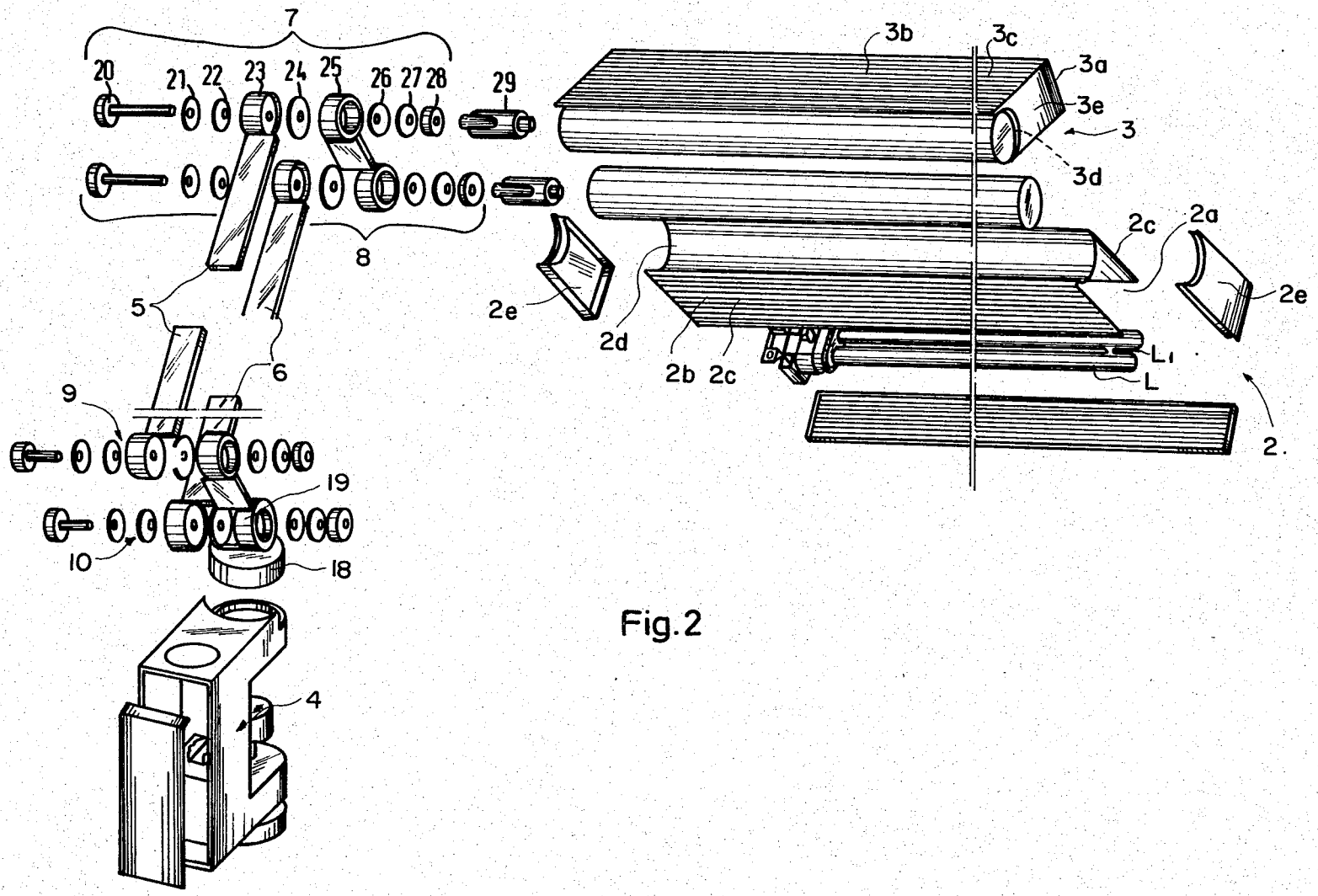
Figure 3:
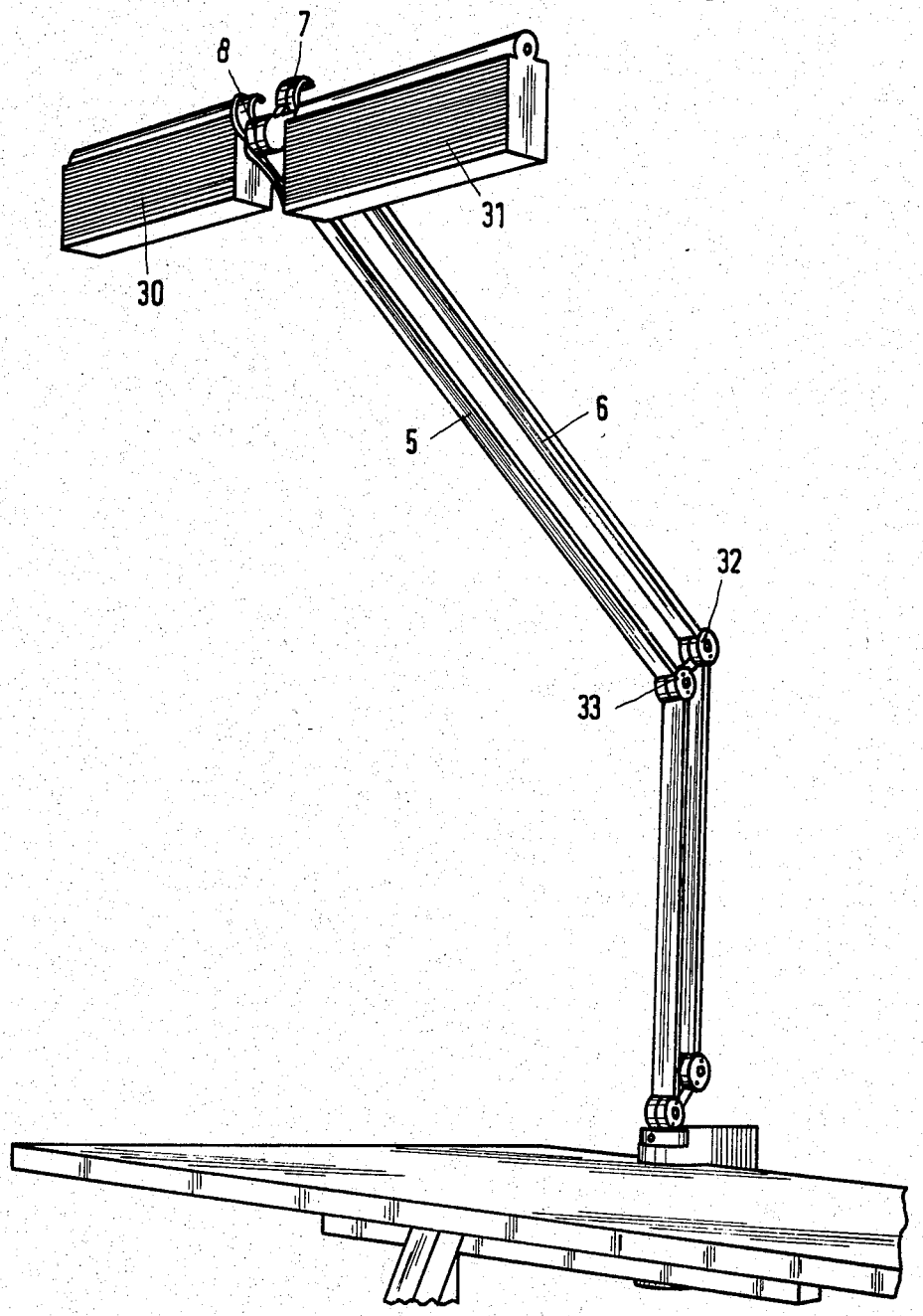

Further details, features and advantages of the object of the invention will be evident from the following description of the accompanying drawings, in which preferred embodiments of the entire lamp are shown diagrammatically in perspective and in detail. In the drawing, FIG. 1 is a complete perspective view of a picture-screen work-station lamp with lamp bodies arranged on one side, FIG. 2 is an exploded view of a picture-screen work-station lamp, and FIG. 3 is a complete perspective view of a picture-screen work-station lamp with lamp bodies arranged on both sides.

The picture-screen work-station lamp in accordance with the complete perspective view of FIG. 1 consists of a holder 1 via ball joints 29 and to one end of the holder there are fastened lamp bodies 2, 3 which are individually displaceable in space independently of each other and to the other end of which a swivel base 4 is fastened. The holder 1 is constructed in bar shape of two bars 5, 6 which are connected movably with each other in a parallelogram arrangement, the bars being connected to each other by four swivel joints 7, 8, 9, 10 and short transverse bars 11, 12. The connection is such that the holder 1 is displaceable upwardly and downwardly in the plane of the parallelogram by means of the swivel joints. The swivel joints are self-locking so that a position which has been established is retained without additional means.

The swivel base 4 serves to assure the three-dimensional swingability of the holder 1 and thus of the lamp bodies 2 and 3. It consists of a U-shaped bracket 13 whose lower arm bears, within a threaded hole, a spindle 15 which is adjustable by means of a knurled nut 14, on which spindle a clamping plate 16, for instance for clamping to a tabletop, is arranged within the open space of the U. In the upper free arm of the bracket 13, within a recess 17, a turnable disk 18 is mounted for movement on a planar bearing, one articulation part 19 of the swivel joint 10 of the holder 1 being fastened on said disk. The associated second part of the articulation bears the bar 6 of the parallelogram arrangement which—like the other bars—is preferably an aluminum section of rectangular cross-section.

The two lamp bodies 2, 3 are respectively independently movably fastened to the joints 7 and 8 respectively of the holder 1 via the ball joints 29; each of the lamp bodies 2, 3 are identical to each other in shape and are of flat construction with emergence of light from an open longitudinal narrow side 2*a*, 3*a*, respectively. They consist specifically of flat, substantially rectangular aluminum housings (casings 2*b*, 3*b*). These housings are formed as channel reflectors, in each of which a lamp L is mounted. The lamp L is preferably a parallel lamp connected at portion $L_1$ adjacent a free end and with a mounting portion at the other end. These lamp housings 2*b*, 3*b* have substantially parallel longitudinally elongated sides 2*c*, 3*c* defining a narrow channel for the light to emerge from the longitudinal open narrow side 2*a*, 3*a*, respectively, a longitudinal narrow convex (relative the open side 2*a*, 2*b* of the housing) side 2*d*, 3*d* adjacent the lamp L and substantially the width of the lamp. Finally side plates 2*e*, 3*e* close off the lateral sides of the casings 2, 3.

The construction of the individual parts, particularly the joints and the swivel base, can be noted in detail from the exploded view shown in FIG. 2 of the drawing. In accordance therewith each swivel joint 7, 8, 9, 10 consists of a setting screw 20 which extends through the joint for changing the frictional force produced between the two parts of the joint, two spring washers 21, 22, one joint part 23, a friction washer 24, the second joint part 25, another two spring washers 26, 27 and a screw cover 28. In the embodiment shown, the setting screws 20 of joints 7 and 8 are lengthened and screwed to, thus providing the possibility of screwing the ball joints 29, the other ends of the ball joints are connected to the lamp bodies 2 and 3 providing the latter with three dimensional adjustability.

From the exploded view it can further be noted that the clamp 13 is formed as a hollow member, suitable for the passage of the electrical connecting wires and to receive a switch.

FIG. 3 shows an embodiment which is substantially identical to the picture-screen work-station lamp described above the lamp bodies 30, 31 are fastened in a manner extending towards opposite sides (on both sides of the holder) to the two upper swivel joints 7, 8. Furthermore an intermediate joint 32, 33, in the form of a swivel joint of the above-described construction, is arranged in the respective parallelogram bars 5, 6.

I claim:

1. A lamp for a picture-screen work station comprising a base including means for securing said base to a support, a holder of bar shape swingably articulated to said base, two non-coaxially lamp bodies each independently movably articulated to said holder, a light bulb having a predetermined width being mounted in an interior of each of said lamp bodies, said holder includes joint means for moving said holder, each of said two lamp bodies are of substantially identical elongated shape, each of said lamp bodies comprises substantially a narrow, rectangular prism casing defining said interior as a narrow channel and having an opening at a first longitudinal narrow side of said narrow channel of said rectangular prism casing from which light from said bulb emerges, said light bulb being mounted in the channel adjacent a second longitudinal narrow side of said narrow channel of said rectangular prism casing opposite and spaced from said opening and being parallel longitudinally thereto, said second longitudinal narrow side of said narrow channel of said rectangular prism casing has formed thereon a convex surface facing toward said opening, said rectangular prism casing has a narrowest width adjacent said second longitudinal narrow side substantially equal to the width of said bulb, and said rectangular prism casing having a longitudinal length and height which is large relative to said narrowest width of said rectangular prism casing.

2. The lamp according to claim 1, wherein said bulb is a double parallel bulb having a connected free end.

3. The lamp according to claim 1, wherein said casing is made of aluminum.

4. The lamp according to claim 1, wherein said base comprises a U-shaped clamp bracket, a disc rotatably mounted on said base on a bearing for swinging movement about a vertical axis and connected to said holder.

5. The lamp according to claim 1, wherein said joint means includes setting screw means for tightening frictional force between bearing parts of said joint means so that said joint means is self-locking.

6. The lamp according to claim 1, wherein the convex surface extends convexly uniformly from one large rectangular side wall of the casing to another large rectangular side wall of the casing.

7. The lamp according to claim 1, further comprising ball joints respectively for independently movably connecting said two lamp bodies to said holder.

8. The lamp according to claim 7, wherein said ball joints are connected to different of said joint means of said holder.

9. The lamp according to claim 1, wherein said holder comprises bars extending upwardly and rearwardly and articulated by said joint means in an adjustable parallelogram.

10. The lamp according to claim 9, wherein said holder is swingably articulated to said base for swinging about a vertical axis, and said joint means is for raising said holder, said bars being disposed in a vertical plane.

11. The lamp according to claim 10, wherein said base includes a horizontally revolving disc, and one of said joint means is secured to said disc.

* * * * *